United States Patent [19]

Smith et al.

[11] Patent Number: 4,973,166

[45] Date of Patent: Nov. 27, 1990

[54] PARTICULATE MATERIAL CONDITIONER

[75] Inventors: Robert J. Smith, Newaygo; Frederick L. Walter, White Cloud; Larry J. Palmer, Grant, all of Mich.

[73] Assignee: Sandmold Systems, Inc., Newaygo, Mich.

[21] Appl. No.: 469,915

[22] Filed: Jan. 24, 1990

[51] Int. Cl.[5] ..... B28C 7/06

[52] U.S. Cl. ..... 366/27; 366/49; 366/66; 366/133; 366/186; 366/271; 366/300

[58] Field of Search ..... 366/16, 27, 46, 49, 366/64, 65, 66, 76, 92, 96–98, 133, 182, 186, 218, 271, 279, 297, 300, 325, 607; 261/83, 84

[56] References Cited

U.S. PATENT DOCUMENTS

| | | | |
|---|---|---|---|
| 2,409,646 | 10/1946 | Seaman | 366/27 |
| 3,262,680 | 7/1966 | Balazer | 366/297 |
| 3,656,718 | 4/1972 | Cairelli | 366/300 |
| 4,060,167 | 11/1977 | Smith | 366/271 |
| 4,164,597 | 8/1979 | Smith | 366/66 |
| 4,368,984 | 1/1983 | Rikker | 366/16 |
| 4,610,545 | 9/1986 | Tomlinson | 366/64 |
| 4,712,919 | 12/1987 | Bouldin | 366/133 |
| 4,752,134 | 6/1988 | Milek | 366/27 |
| 4,832,498 | 5/1989 | Milek | 366/186 |

FOREIGN PATENT DOCUMENTS

| | | | |
|---|---|---|---|
| 1-043336 | 2/1989 | Japan | 366/186 |
| 1-71809 | 7/1989 | Japan | 366/16 |

*Primary Examiner*—Timothy F. Simone

*Attorney, Agent, or Firm*—Price, Heneveld, Cooper, DeWitt & Litton

[57] ABSTRACT

A machine for conditioning granular materials includes a dual section chamber through which a transport belt travels and in the first chamber of which are a pair of closely spaced counter-rotating heads so driven that the material is moved toward the narrow gap between the heads. The shafts on which the heads are mounted extend upwardly, are parallel and also are inclined upwardly at a minor angle to the vertical in an upstream direction with respect to the direction of movement of material through the equipment. Each head is equipped with blades of two different designs to perform different functions.

15 Claims, 5 Drawing Sheets

PARTICULATE MATERIAL CONDITIONER

SUMMARY OF THE INVENTION

A machine for mixing and conditioning granular materials being transported on a moving surface, such as a belt, beneath blades for aerating, mixing and breaking up lumps in the granular materials and aerating the materials, which blades are mounted and rotated about generally vertical shafts.

BACKGROUND OF THE INVENTION

Many granular materials require processing to condition them for use. In some cases, the conditioning is primarily to breakup and eliminate any clumps or lumps that may exist in these granular materials to be certain that they are all uniformly in the granular form. In other materials, equipment of this type is used to mix or blend materials together so that additives which have been applied to the materials are thoroughly and uniformly intermixed throughout the body of the granular materials. Such additives as oil, bonding agents, coloring materials, coatings, binders, lubricants and chemicals of various types are among the materials which have to be intermixed uniformly throughout the body of these granular materials. It is important in this operation that the granular materials, after processing, are uniform in consistency whereby there will not be voids resulting from under treatment and other defects due to zones of concentration of the materials which have been mixed with the granular substances. Equipment of this type is also utilized for cooling or for drying granular materials. While the invention is particularly applicable to the preparation of molding sand for foundry use, this is but one of its many possible uses.

Heretofore, equipment designed for this purpose and particularly the equipment designed for use with foundry molding sand has utilized blenders and conditioners having paddle wheel type sand blending and mixing rotor wheels which are mounted to rotate about a horizontal axis above the surface of a material transport belt. While this arrangement does provide a degree of mixing and blending, it does not so completely and positively treat the material as to effectively aerate and mix it or to positively breakup all lumps which might exist in the material. While these blenders or conditioners which rotate about a horizontal axis, due to the lifting of the material accomplish some aeration of the material, they do not provide the positive and, in effect, high energy movement of the materials necessary to assure both blending and lump breakup. Furthermore, conventional equipment for this purpose cannot, process lumps efficiently since the rotor wheel mounted on a horizontal axis has a tendency to jam lumps downward onto the belt. Cooling is also difficult in that air cannot be easily introduced into the area where the rotor wheel and sand combine. It is the purpose of this invention to provide equipment which is dependably effective for both of these purposes and, at the same time, useful in the preparation and conditioning of a wide variety of granular type materials.

BRIEF DESCRIPTION OF THE INVENTION

The invention provides a self-contained unit having a conditioning chamber and a collection chamber through which materials are moved in sequence on a continuously moving belt. In the conditioning chamber, the materials are positively forced to travel as a stream into a pair of rotating conditioner blades which are rotated in opposite directions so as to propel the material toward a very narrow path between them. In this manner, the material is forcibly and positively acted upon by the blades. These blades are mounted on generally parallel shafts which are inclined at a minor angle downstream of the direction of the movement of the belt and the load of materials which it is transporting. The rotating blades are designed to pass very close to the surface of the belt to thereby assure positive action on all of the material. The conditioning rotors incorporate, in an alternate arrangement, an equal number of two types of blades. One type of blade is designed to pass very close to the surface of the transporting belt to assure movement of all of the granular material with alternate blades being curved so as to apply a lifting and throwing type of movement to the granular material with the result that the granular material is moved to the center between the blades and is forcefully ejected in a steady, upwardly inclined, fan shaped discharge pattern at a velocity such that the individual granules are caused to be separated and to be airborne where they will become aerated. Because the granular material is confined closely at the sides, as it approaches the rotating blades, it is basically forced into the zone adjacent the confluence of the blades and is thereby positively engaged by the blades not only to be accelerated but also to be forced upwardly where the granules will be caused to separate and spread out. A third type of blade which would act in similar fashion to a turbo compressor can be fitted above the lower blades so as to draw in outside air and centrifugally mix said air into the sand as the air is thrown out by the lower blades. This feature can be adapted to units whose purpose is to both cool and blend or cool and cause lump reduction.

Downstream of the movement of the belt, means are provided to cause the separated granular material to once more be deposited on the belt for transport out of the unit. The entire unit is designed to be an integrated, compact system which can be incorporated into a much larger system such, for example, as would be used in a foundry where at least some of the sand would be recovered from prior casting operations by the steps of removing the sand and the castings from the molds and then separating the castings from the sand. The intended invention is especially useful here in that the two counter-rotating rotors will provide improved lump reduction compared to a conventional unit wherein the sand is passed between a stationary belt and one downwardly rotating paddle wheel. The sand so recovered may then be passed through an initial treatment to positively break up any clumps and to initiate the process of aeration. This would be a first step in reconditioning the sand. This invention can be used for this initial reconditioning operation. Under different foundry operating conditions, this first step can be dispensed with and the recovered sand prepared for reuse, perhaps with the addition of additional fresh foundry sand and various other materials, such as binders. The sand to which this has been done then enters the blender and aerator which is the subject of this invention. The manner in which the equipment acts on the material makes the equipment particularly effective as a machine for mixing, lump reduction, cooling and blending. Thus, the equipment, while particularly applicable to the sand casting foundry field, has the potential of widespread use outside the foundry field. An example of such a use would be in a facility for preparing the dry mix of cement and aggregate in a plant preparing dry ready mix which will be bagged for sale. These and other objectives and purposes of this invention will become clear upon reading the following specification and the accompanying drawings.

DESCRIPTION OF THE PREFERRED EMBODIMENT

Figure 1:
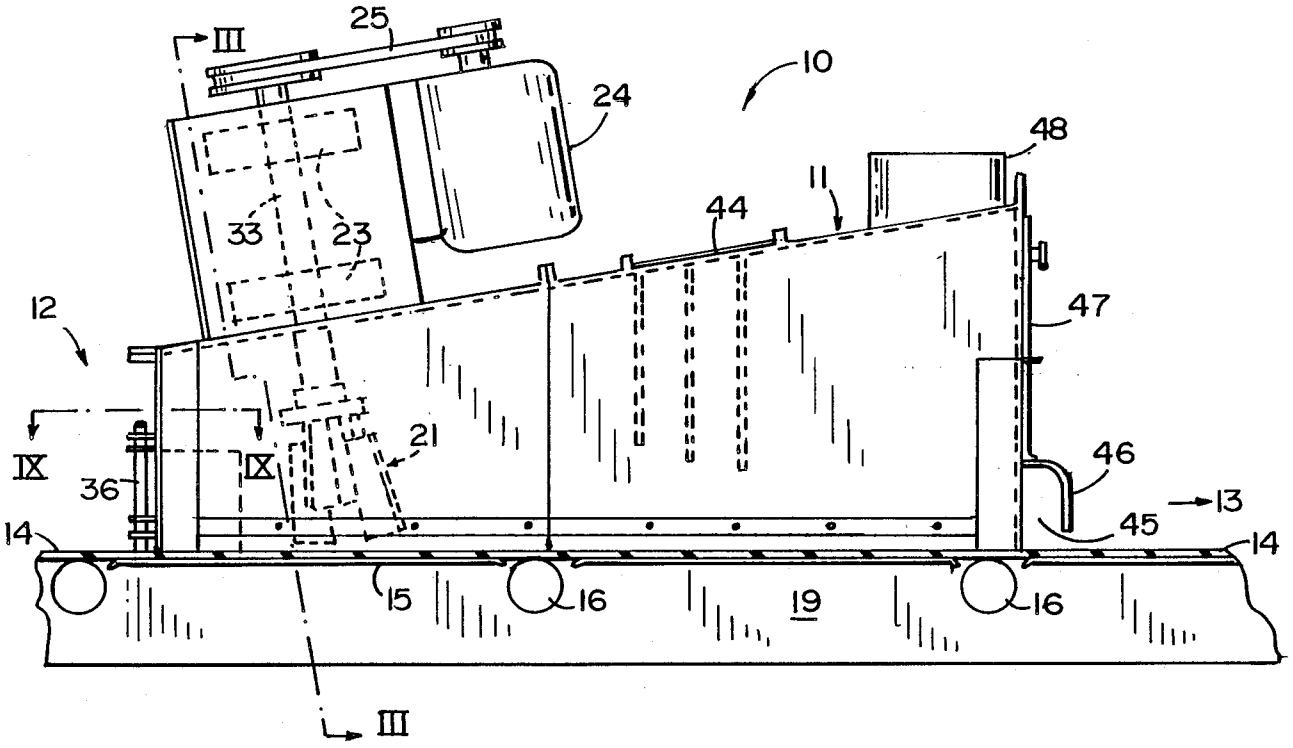
FIG. 1 is a side elevation view of the invention.

Referring to FIG. 1, the numeral 10 refers to a machine for conditioning granular materials. The machine incorporates a tubular housing 11 having a material receiving end 12 and a material discharge end 13 at the opposite end. Between these ends the housing provides a passage for materials passing through the equipment. A driven belt 14 passes through the housing and forms, in effect, the floor or bottom of the material processing chambers contained within the housing 11. The belt is supported on a floor 15 and spaced idler rollers 16. The belt is driven by conventional means, not illustrated, so that it acts as a transporting surface to move material to be processed through the equipment.

Figure 3:
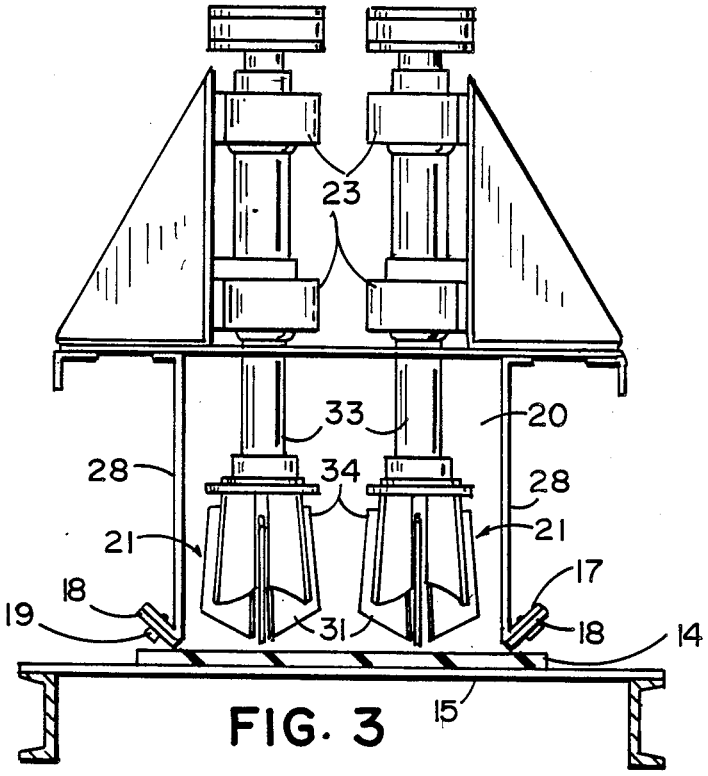
FIG. 3 is a sectional view taken along the plane III—III of FIG. 1.

As best seen in FIG. 3, the belt 14 is wider than the material treating chamber between the side walls 28 of the housing over the belt. The bottom edges of these walls are turned upwardly and outwardly to form an inclined flange 17. Secured to each of these flanges is a skirt 18 of a wear-resistant, flexible material. The lower edges of these skirts 18 seat against the belt 14 to effect a seal to prevent lateral escape of material being transported by the belt. The skirts can be manufactured from suitable materials such as reinforced, molded rubber or synthetic resin and secured to the flange by bolts 19.

Figure 4:
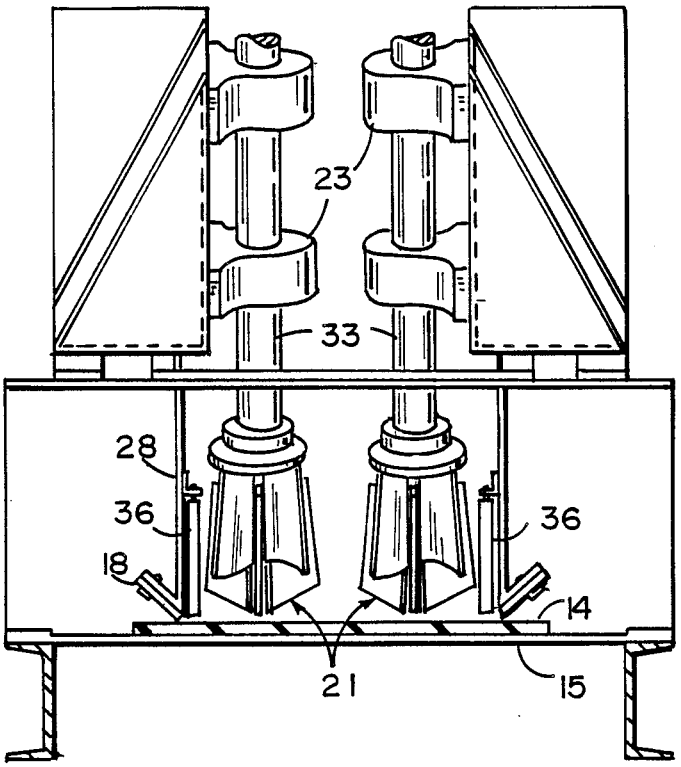
FIG. 4 is an end elevation view of the material entry end of the equipment with the end panels removed.

The sand is also urged into the path of the treatment heads 21 by the wing panels 36 shown in FIG. 4. These act to push the sand into the path of the treatment heads. These panels have been omitted in FIG. 3 to simplify illustration.

Figure 2:
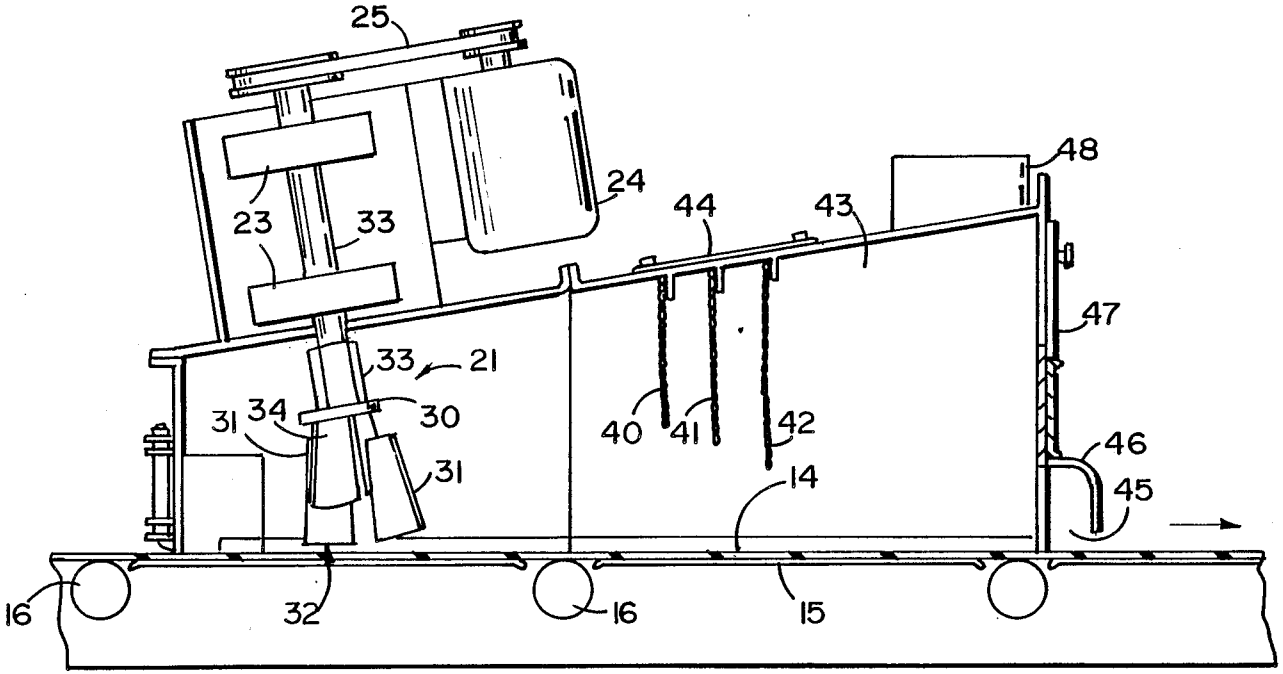
FIG. 2 is an elevation view similar to FIG. 1 but with the side panels of the material treatment chamber removed.
Figure 5:
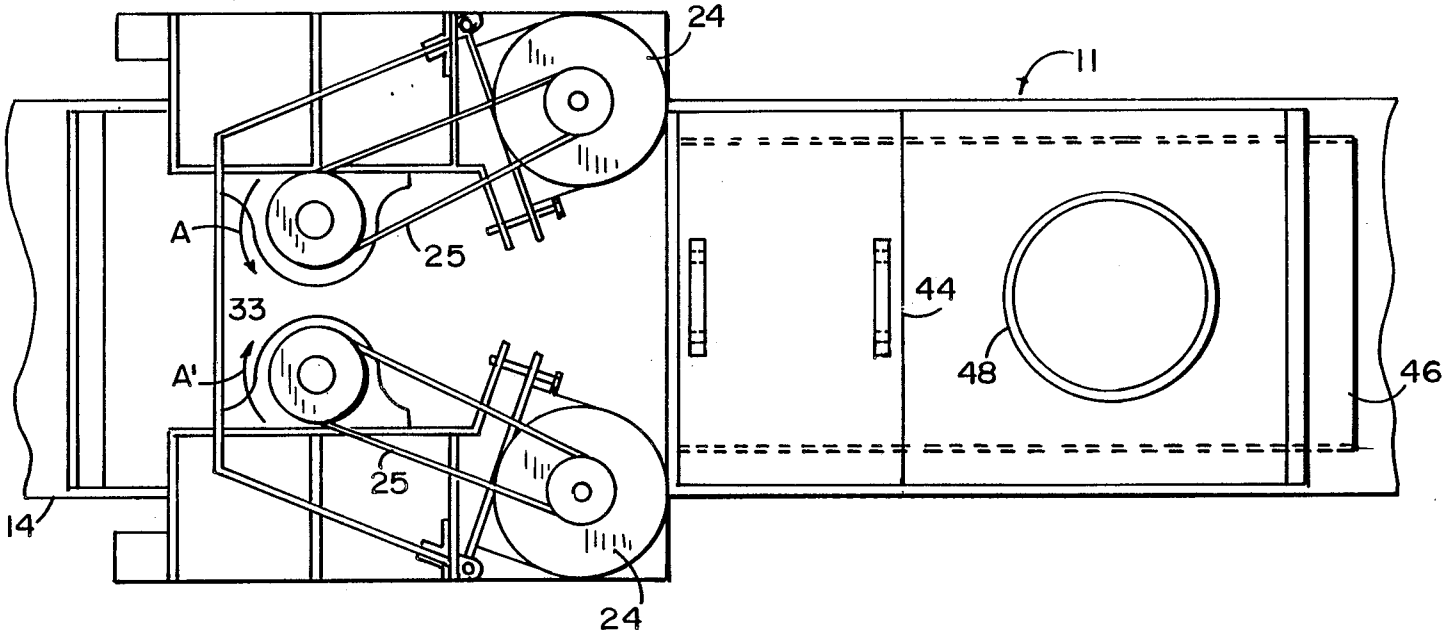
FIG. 5 is a plan view of the invention.
Figure 6:
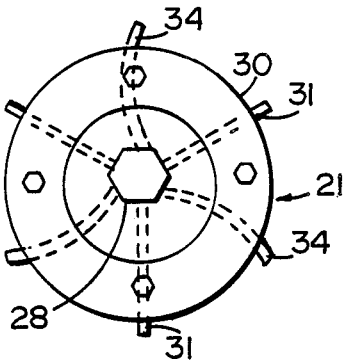
FIG. 6 is a top plan view of one of the material treating heads.

As best seen in FIG. 2, the upstream or processing chamber 20 contains a pair of material treatment heads 21. Each of these heads is mounted on a separate shaft 22, which shafts are supported by suitable trunions 23 in the drive chamber above the chamber 20. The lower ends of the shafts may have a non-circular configuration, such as hexagonal. Each of the shafts is driven by a separate prime mover 24 through suitable means such as a belt 25. The prime movers rotate in opposite directions so that the shafts 22 and, thus, the treatment heads 21 are driven as indicated by the arrows A and A′ in opposite directions (FIG. 5) such that the material being moved toward the treatment heads 21 will be moved toward the center of the belt 14.

The shafts 22 are parallel to each other and both are inclined at an identical angle B away from the vertical toward the material receiving end 12 of the treatment chamber (FIG. 2). Preferably, the angle B is approximately 10°. The functional purpose of this inclination will be explained subsequently.

Figure 7:
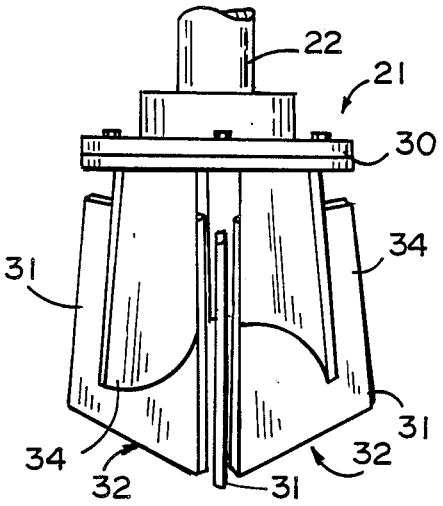
FIG. 7 is an elevation view of the material treating head illustrated in FIG. 6 as it would appear were its shaft vertical.
Figure 8:
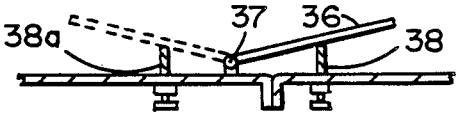
FIG. 8 is a sectional view taken along the plane IX—IX of FIG. 1 showing one of the baffles used to confine the flow of sand as it approaches the material conditioner blades.

Each of the treatment heads 21 is identical, having six or more blades each secured to and extending downwardly from a header plate 30 (FIG. 7). If the end of the shaft 22 is non-circular, the header 30 will have an opening 28 of similar configuration. Each treatment head has two types of blades which are alternately spaced. The blades 31 of one type are designed to be the sweepers or collectors which, as they pass over the belt 14 on the upstream side of their rotation, pass very close to the surface of the belt and act to pick up the material close to the belt and accelerate it rapidly downstream and toward the center of the belt. These blades have bottom edges 32 which are inclined upwardly at the same angle as the inclination of the shafts 22 and, thus, as they sweep past the upstream side of the shafts 22, their lower edges are parallel with the surface of the belt 14. These sweeper blades are rigidly secured to the central spindle 33 of the treatment head 21 by suitable means such as welding and, in the particular construction illustrated, terminate a short distance below the header plate 30. Each sweeper blade 31 is a flat plate and projects radially from the central axis of the treatment head.

Circumferentially centered between each of the sweeper blades 31 is a material discharge and spreader blade 34. The upper ends of the spreader blades are secured to the header plate 30 and the lower ends are spaced significantly upwardly from the lower ends of the sweeper blades 31. Further, the outer ends of the spreader blades 34 are backwardly curved at a small angle backward with respect to the direction of rotation of the treatment head on which they are mounted. Thus, these blades are adapted to perform their primary function which is to accelerate and throw, over a widely distributed, fan-shaped pattern the granular material which has been scooped up by the sweeper blades. The curved ends accelerate the radial discharge of the material which is forced upwardly into their path by the sweeper blades 31. The combined operation of these two types of blades creates an upwardly, arcuate-type discharge pattern of the sand, spreading it the entire width of the passage through which the belt 14 passes. Since the sand is thrown upwardly in a fan-shaped pattern, the individual grains are caused to separate, helping in the breaking up any lumps and also causing each individual grain of sand to fall back onto the belt as a result of its own gravity, retarded by the air friction incident to its fall. This is important to the breakup of the granular material and to its being fluffed because it will descend gravitationally rather than being forcibly compacted grain by grain against each other and, thereby, once reinitiate formation of lumps and a tightly packed formation. The effectiveness by which this design separates the individual granules of the material can be better understood when it is realized that the treatment heads are driven at approximately 2000 rpm and, thus, impart a very high velocity to the granular particles and also discharge the sand in a fan-shaped pattern where the sand grains quickly move away from each other as they leave the driven heads. Further, they are also moved upwardly at a steeply inclined angle to increase the time interval during which they will be airborne and urged along divergent paths and, thus, caused to further separate from each other. This is in direct contrast to previously utilized conditioners of granular materials which tended only to elevate and discharge the particles in a straight path rather than forcibly discharge them in an upwardly inclined and divergent pattern to positively induce and accelerate separation.

With the conventional, reel-type conditioner, a single reel and power source was involved and in conventional construction, the material was lifted and accelerated by the same paddle or vane across the entire width and depth of the granular material. In the case of heavy materials, such as foundry sand, this imposed a heavy load on the equipment and seriously restricted the speed at which the equipment could be operated. This invention divides the load between two propelling units for picking up and accelerating the granular material. Further, in this type of equipment, the blades which pick up the material and accelerate it enter the material gradually rather than the entire blade entering the material simultaneously. Thus, the load imposed on each blade which must be overcome by the equipment powering it, is imposed gradually with a period of acceleration. Thus, the load increases over an interval of time and, expressed graphically, would appear as a sharply accelerating curve rather than as a vertical line with its resultant shock-wave type of loading. As a result, this equipment can handle a greater volume of material without the equipment wear and energy demand necessary and inherent in heretofore known equipment.

Downstream of the treatment heads 21 a plurality of precipitators are provided to decelerate the sand discharged by the treatment heads. These may also consist of a plurality of elongated strips or bars 40, 41 and 42 which may be chains or a high density, wear-resistant plastic material such as vinyl suspended in the path of the sand discharged by the treatment heads 21. The precipitators are suspended in the path of the materials which have been lifted and accelerated by the blades of the treatment heads 21.

In a preferable construction for this deceleration equipment, the bars are arranged in groups 40, 41 and 42 (FIG. 2). These bars are spaced apart a short distance and simply depend from the roof of the collection chamber 43. As will be readily seen from FIG. 2, each group of bars, downstream of the movement of the belt, is longer than the group of bars ahead of it. This reflects the deceleration imposed on the granular material by the bars ahead of it. Also, the bars of each group may be arranged in a pattern such that they are centered in the gaps between the bars of the group immediately upstream.

These bars have to be heavy enough to not only withstand the abrasive effect of the accelerated materials for a reasonable period of time but also to remain at least largely vertical despite the impact of the material discharged by the treatment heads 21. The bars have to be of a heavy enough material that their mass is sufficient to offer significant resistance to the continued movement of the material even though the material is heavy and massive, as would be the case with a substance such as foundry sand. These chains also must be so mounted that they can be replaced readily because of a high incidence of wear. For this purpose, immediately above the chains, the housing is provided with an access door 44 to facilitate replacement. The deenergized material precipitated by the the chains is redeposited on the belt 14 and is transported to the far end where it is removed from the unit by the belt through the discharge opening 45. At this end, a hood 46 is provided to positively deposit onto the belt surface any granular material which has not already been deposited by the bars 40, 41 and 42. Above the hood 46, a further access door 47 is provided to facilitate service of the interior of the unit. Any dust of similar airborne type materials is exhausted through the conduit 48.

Figure 9:
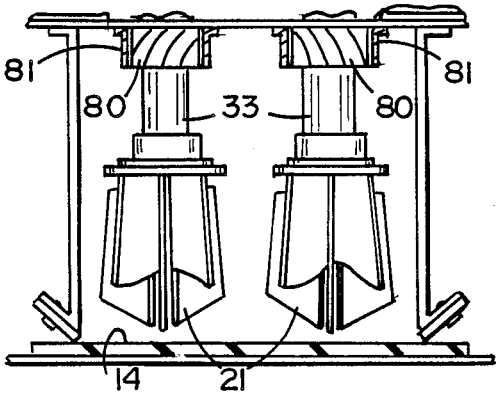
FIG. 9 is a fragmentary sectional view of a modified construction taken along the same plane as FIG. 3.

As best seen in FIG. 1, the wing panels 36 are mounted on vertical spindles 37 upstream of the treatment heads. Their pivotal movement toward the sides of the housing under the pressure exerted by the incoming sand is limited by the downstream stop 38 (FIG. 9). The stops for these panels are adjustable so that their position can be adjusted to most effectively direct the incoming sand into the path of the treatment heads 21. However, since this equipment is designed for use in the reconditioning of foundry sand, provision must be made for emergencies such as are created by lumps of sand too big or too firm to be broken up by the treatment heads or for a casting being missed by the separation equipment and remaining in the sand. When this occurs, the equipment is designed to stop. The direction of the belt 14 can then be reversed to remove the obstruction back out of the equipment. To accommodate this, the wing panels are designed to be pivoted by the material on the belt so that they are urging the sand inwardly of the belt but doing so while extending upstream of the normal operating direction of the belt. This condition is illustrated in phantom in FIG. 9. In this direction, their pivotal movement is limited by the stop 38*a*.

FIG. 9 illustrates a modification wherein the shafts 33 are each equipped with means for generating a positive airflow into the housing 11. This can be done by mounting on each of the shafts 33 a suitable airflow generating wheel 80 which may be of any suitable construction but preferably is equipped with blades which are of the curved, turbo compressor tube configuration. Preferably, these are surrounded by a tubular shell 81 to further direct the resulting airflow downwardly against the accelerated material being discharged by the treatment heads. The shells could be so constructed that the stream of air discharged by shells on the upstream side of the airflow generating wheels is partially deflected downstream into the stream of sand which has been discharged and elevated by the treatment heads 21. This arrangement is partially effective since the shafts 33 are inclined downstream of material movement.

It will be recognized that, while the belt 14 is illustrated as entering the unit as if the unit were provided as only one item of equipment, in the larger treatment systems with the material leaving the unit and going on to other facets of the overall system on the same belt, the unit could be built as a totally integrated unit which is not, itself, part of a larger system. This would be true if the unit were used as a mixing and blending unit for granular materials rather than as a foundry sand conditioner.

The invention provides a compact and self-contained unit for effectively treating granular materials for a number of purposes. While it is particularly suitable for conditioning foundry sand, it can be used in a number of other processes where a granular material needs to be cooled and separated or, as the term is used in certain industries, "fluffed" on a continuous basis. It could be used to blend dry, granular materials, such as blending sand or gravel and dry cement to provide a mix suitable for packaging and being sold as a "ready-to-use" product.

It could be used to blend together the soil, organic materials and fertilizer for potting soils for the nursery industry. These are simply exemplary uses. It can also be used to mix or blend discrete materials in the nature of dry, granular materials with other dry, granular materials such as coatings, adhesives, hardeners, binders and chemicals of various types. It can also be used as an aerator or a drier. It provides equipment capable, in a single pass, of a much higher degree of treatment with uniformity of processing at a higher throughput rate than has heretofore been achieved. At the same time, the equipment is basically simple and adaptable to existing processes of various types.

It will be recognized that a number of modifications of the invention can be made without departing from its principles. Such modifications are to be considered as included in the hereinafter appended claims unless these claims, by their language, expressly state otherwise.

We claim:

1. Means for conditioning granular materials, said means comprising: an elongated housing having side walls defining a material treatment zone and a material collection zone arranged in tandem; a driven endless belt forming a material transport surface passing through both of said zones and serving as the floor portion thereof, a pair of upwardly extending shafts and means supporting said shafts above said belt in said treatment zone, said shafts being inclined downstream of the direction of movement of said belt at a minor angle to the perpendicular, a head mounted on the lower end of each of said shafts, each of said heads having a plurality of radially extending blades the lower edges of which are inclined to the axes of said shafts such that as they pass above said belt at the upstream portion of their rotation said lower edges are parallel to the surface of said belt; means for counter-rotating said shafts such that the portions of said heads adjacent the centerline of said belt are both moving downstream with respect to the direction of travel of said belt.

2. Means for conditioning granular materials as described in claim 1 wherein the gap between the blades of said heads is approximately one-half inch.

3. Means for conditioning granular materials as described in claim 1 wherein two types of blades are mounted on each of said heads, said blade types being arranged alternately of each other, the first type of said blades being material accelerating blades having a lower edge passing close to the belt at the upstream segment of its rotation, the second type of said blades being shorter than said first blades, having their lower edges further spaced from said belt and the outer radial portion thereof being backwardly curved with respect to the direction of rotation thereof to accelerate the radial discharge of granular materials.

4. Means for conditioning granular materials as described in claim 3 wherein said blades are equally spaced.

5. Means for conditioning granular materials as described in claim 3 wherein the ends of said first blades opposite from said belt are spaced substantially below the upper end of said second blades whereby an escape passage is created for material engaged by said first blades in excess of that which the blades can discharge radially.

6. Means for conditioning granular materials as described in claim 1 wherein a plurality of spaced dependent members are provided in said collection zone for decelerating and precipitating back onto said belt the material discharged from said material treatment zone by said blades.

7. Means for conditioning granular materials as described in claim 6 wherein said dependent members are bars of abrasion resistant plastic arranged in parallel to form panels, each panel including a plurality of said bars arranged at spaced intervals transversely of said chamber.

8. Means for conditioning granular materials as described in claim 7 wherein the bars of each of said panels progressively downstream of the direction of movement of materials by said heads are of increasingly greater length.

9. Means for conditioning granular materials as described in claim 6 wherein said dependent members are chains.

10. Means for conditioning granular materials as described in claim 1 wherein a pair of skirts are provided extending the length of said housing along the lower portions of the walls of said housing defining said zones, said skirts being secured to said side walls and each having an inwardly and downwardly inclined portion shaped and positioned to engage said belt and confine the granular material to said housing.

11. Means for conditioning granular materials as described in claim 10 wherein the bottom edges of the side walls of said housing are bent upwardly and outwardly at a point closely adjacent said belt to form flanges, a strip-like, flexible wear-resistant seal means secured to the lower face of each of said flanges, said seal means seating against said belt to prevent lateral escape of the material from said housing.

12. Means for conditioning granular materials as described in claim 1 wherein material guides are provided, one on each side of the transport surface upstream of the direction of movement of material on said transport surface with respect to said heads, said guides overlying the surfaces of said belt and being upstream of said heads and inclined with respect to the centerline of said transport surface to urge material inwardly into the path of said heads.

13. Means for conditioning granular materials as described in claim 1 wherein means are provided to reverse the direction of travel of said belt in the event that the incoming material had lumps too big to be passed through the equipment or capable of causing the equipment to stall.

14. Means for conditioning granular materials as described in claim 1 wherein air movement acceleration means are mounted on each of said shafts above said heads for directing a stream of air into the sand discharged by said heads.

15. Means for conditioning granular materials as described in claim 14 wherein said acceleration means is surrounded by a tubular shell the upper end of which communicates with the exterior of said housing through an annular opening surrounding each of said shafts.

* * * * *